US006506107B2

(12) United States Patent
Clowers et al.

(10) Patent No.: US 6,506,107 B2
(45) **Date of Patent: *Jan. 14, 2003**

(54) SANDER

(75) Inventors: Earl R. Clowers, Jackson, TN (US); John W. Schnell, Jackson, TN (US)

(73) Assignee: Porter-Cable Corporation, Jackson, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/804,836

(22) Filed: Mar. 13, 2001

(65) Prior Publication Data

US 2002/0031992 A1 Mar. 14, 2002

Related U.S. Application Data

(63) Continuation of application No. 08/953,811, filed on Oct. 20, 1997, now Pat. No. 6,224,471, which is a continuation of application No. 08/613,147, filed on Mar. 8, 1996, now Pat. No. 5,791,977, which is a continuation of application No. 08/334,855, filed on Nov. 4, 1994, now Pat. No. 5,518,442, which is a continuation of application No. 08/009,309, filed on Jan. 22, 1993, now abandoned.

(51) Int. Cl.[7] ..... B24B 23/03; B24B 55/10

(52) U.S. Cl. ..... 451/359; 451/357

(58) Field of Search ..... 451/359, 357, 451/344, 456, 453; 55/523, 527, DIG. 2; 15/347, 349

(56) References Cited

U.S. PATENT DOCUMENTS

| | | |
|---|---|---|
| 2,499,933 A | 3/1950 | Smul |
| 2,895,266 A | 7/1959 | Statler |
| 2,929,177 A | 3/1960 | Sheps |

(List continued on next page.)

FOREIGN PATENT DOCUMENTS

| | | |
|---|---|---|
| CA | 931761 | 8/1973 |
| CA | 1032349 | 6/1978 |
| CA | 1049265 | 2/1979 |
| CA | 1063806 | 10/1979 |
| CA | 1080477 | 7/1980 |
| DE | 3602571 A1 | 7/1987 |
| DE | 3702-960 A | 8/1988 |
| JP | 55-112759 | 8/1980 |
| RU | 747-700 | 7/1980 |
| SE | 1408522 | 10/1975 |
| WO | WO 85/01004 | 3/1985 |

OTHER PUBLICATIONS

Brochure entitled "POREX Porous Plastic Materials", Porex Technologies, Fairburn, Georgia, 1990 (16 pages).

Brochure entitled "An Introduction to Interflo", Interflo, a Division of Chromex Corporation, Brooklyn, New York (8 pages).

(List continued on next page.)

*Primary Examiner*—Eileen P. Morgan
(74) *Attorney, Agent, or Firm*—Merchant & Gould; Suiter & Associates PC

(57) ABSTRACT

A pad sander skirt which flares out over the periphery of the sanding pad and which is coupled to a lower housing so that it swivels about the body of the sander. The skirt and lower housing can be selectively swivelled in a rotational manner to a position desired by the user. A further sander improvement disclosed relates to the protection of a user's hand. Palm-grip random orbit sanders are sometimes configured so that the sanding pad may begin spinning at high speed when the sander is lifted off of the work. To this end, the present application discloses a protective skirt which flares out over the periphery of the pad in a palm-grip random orbit sander. Also disclosed is an improved dust collection system comprising a filter housing formed of a rigid porous material for entrapping dust.

2 Claims, 6 Drawing Sheets

U.S. PATENT DOCUMENTS

| | | | |
|---|---|---|---|
| 3,123,946 | A | 3/1964 | Hoveland |
| 3,594,958 | A | 7/1971 | Cusumano |
| 3,673,744 | A | 7/1972 | Oimoen |
| 3,785,092 | A | 1/1974 | Hutchins |
| 3,824,745 | A | 7/1974 | Hutchins |
| 3,826,045 | A | 7/1974 | Champayne |
| 3,862,521 | A | 1/1975 | Isaksson |
| 3,938,283 | A | 2/1976 | Keith, Jr. |
| 3,964,212 | A | 6/1976 | Karden |
| 3,987,589 | A | 10/1976 | Marton |
| RE29,247 | E | 6/1977 | Kilstrom et al. |
| 4,062,152 | A | 12/1977 | Mehrer |
| 4,071,981 | A | 2/1978 | Champayne |
| 4,135,334 | A | 1/1979 | Rudiger |
| 4,158,935 | A | 6/1979 | Robert |
| 4,164,101 | A | 8/1979 | Robert |
| 4,322,921 | A | 4/1982 | Maier |
| 4,328,645 | A | 5/1982 | Sauer |
| 4,616,449 | A | 10/1986 | Marton |
| 4,671,019 | A | 6/1987 | Hutchins |
| 4,754,575 | A | 7/1988 | Schneider |
| 4,759,152 | A | 7/1988 | Berger et al. |
| 4,851,730 | A | 7/1989 | Fushiya et al. |
| 4,967,516 | A | 11/1990 | Hoshino et al. |
| 5,018,314 | A | 5/1991 | Fushiya et al. |
| 5,080,702 | A | 1/1992 | Bosses |
| 5,090,975 | A | 2/1992 | Requejo et al. |
| D326,398 | S | 5/1992 | Fushiya et al. |
| 5,125,190 | A | 6/1992 | Buser et al. |
| 5,206,967 | A | 5/1993 | Fushiya et al. |
| 5,237,781 | A | 8/1993 | Demetrius |
| 5,261,190 | A | 11/1993 | Berger et al. |
| 5,518,442 | A | 5/1996 | Clowers et al. |

OTHER PUBLICATIONS

Nagyszalanczy, Random–Orbit Sanders, *Fine Woodworking,* Jul./Aug. 1993 pp. 43–47.

Catalog entitled "Black & Decker Industrial Construction Division, Heavy Duty Professional Power Tools & Accessories for Construction and Industry", The Black & Decker Corporation, Towson, Maryland, p. 48.

Seven photos of a Black & Decker Catalog No. 4020–10 TYP–1 sander.

Exhibit A: Two photos of Hoover® Permabag 2 System (undated).

Hoover® Users Instructions for Permabag 2 System; © 1993 (2 pages).

Catalog listing for Ryobi® Dustless Orbital Sander, shown on p. 285 of "1991 Tools on Sale™".

SANDER

CROSS-REFERENCE TO RELATED APPLICATIONS

This application is a continuation of application Ser. No. 08/953,811, filed Oct. 20, 1997 now U.S. Pat. No. 6,224,471 Application Ser. No. 08/953,811 is a continuation of application Ser. No. 08/613,147, filed Mar. 8, 1996, now U.S. Pat. No. 5,791,977. Application Ser. No. 08/613,147 is a continuation of application Ser. No. 08/334,855, filed Nov. 4, 1994, now U.S. Pat. No. 5,518,442. Application Ser. No. 08/334,855 was a continuation of application Ser. No. 08/009,309, filed Jan. 22, 1993, now abandoned. Each of these applications is incorporated herein by reference.

BACKGROUND AND SUMMARY OF THE INVENTION

The present application is directed to sander improvements. These improvements include a pad sander lower housing having a skirt which flares out over the periphery of the sanding pad. The lower housing can be selectively swivelled in a rotational manner to a position desired by the user. This has particular advantages in dustless versions of a sander in which it may be desirable to reposition the dust collection system.

A further improvement relates to the protection of a user's hand. Palm-grip random orbit sanders sometimes are configured so that the sanding pad may begin spinning at high speed when the sander is lifted off of the work. Since palm-grip random orbit sanders can be grasped by a single hand in a manner that might put the user's fingers in contact with a high speed spinning pad, protection against injury is desirable. To this end, the present application discloses a protective skirt which flares out over the peripheral of the pad in a palm-grip random orbit sander. The skirt may be configured for either dustless versions of such sanders, in which case the skirt typically also forms a portion of the dust collection system, as well as with dusty versions of the sander, in which case the primary purpose of the skirt is to prevent contact of the user's hand and fingers with the pad.

In sanders with dust collectors, particularly those that use passive systems such as a cloth bag to catch dust, the dust collection apparatus can be both relatively cumbersome and ineffective. In an improvement to such passive systems, the present application discloses a sander dust collector filter housing formed of a rigid, porous material for entrapping dust. Such a dust collection system can be made,in a compact manner which is particularly suitable for palm-grip sanders, whether the sander be of an orbital, dual action, or random orbit type. Larger versions of such filter housings may be used with larger sanders.

DETAILED DESCRIPTION OF THE PREFERRED EMBODIMENT

Figure 1:
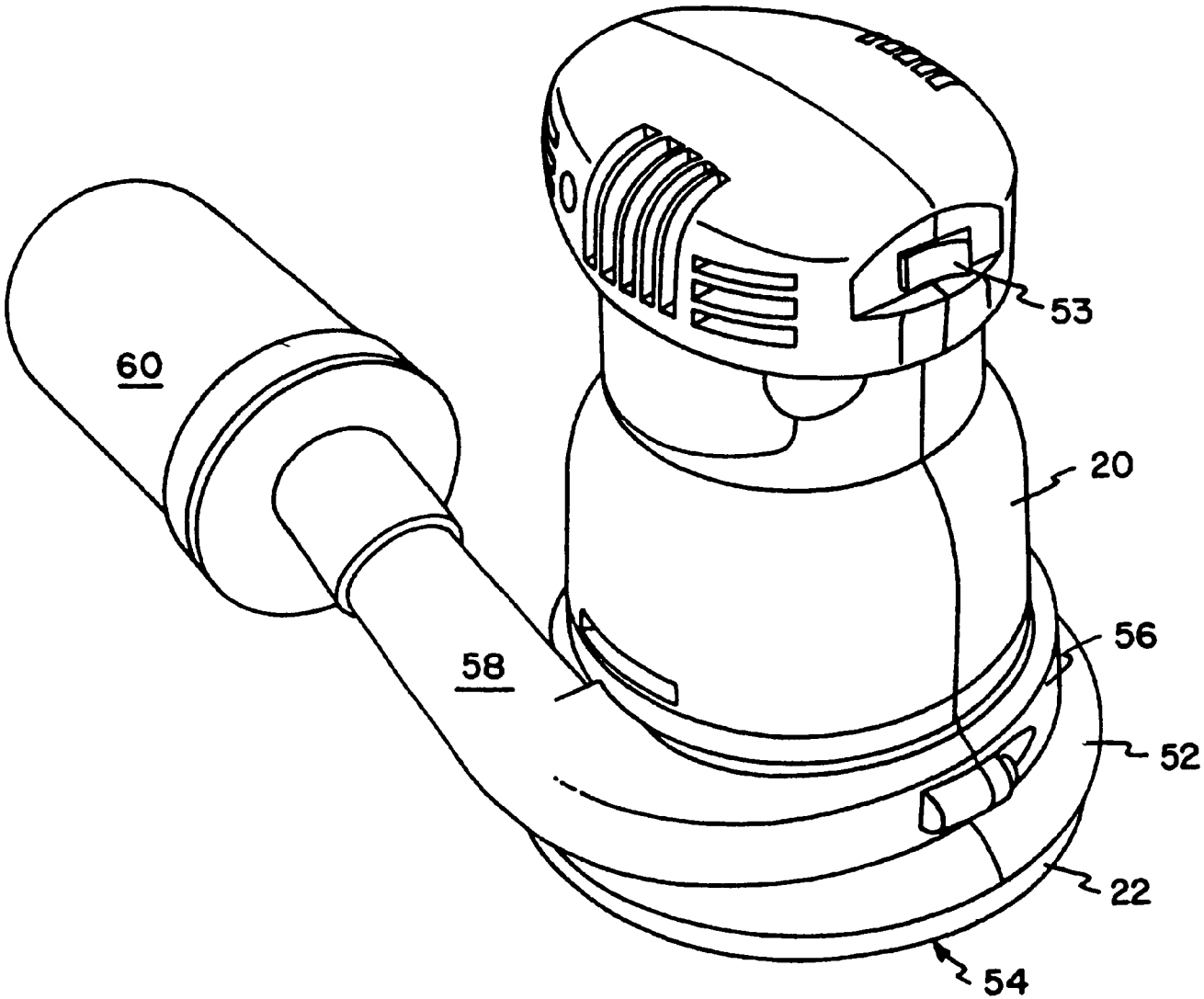
FIG. 1 is a perspective view of a sander which incorporates a dust collection system.
Figure 1A:
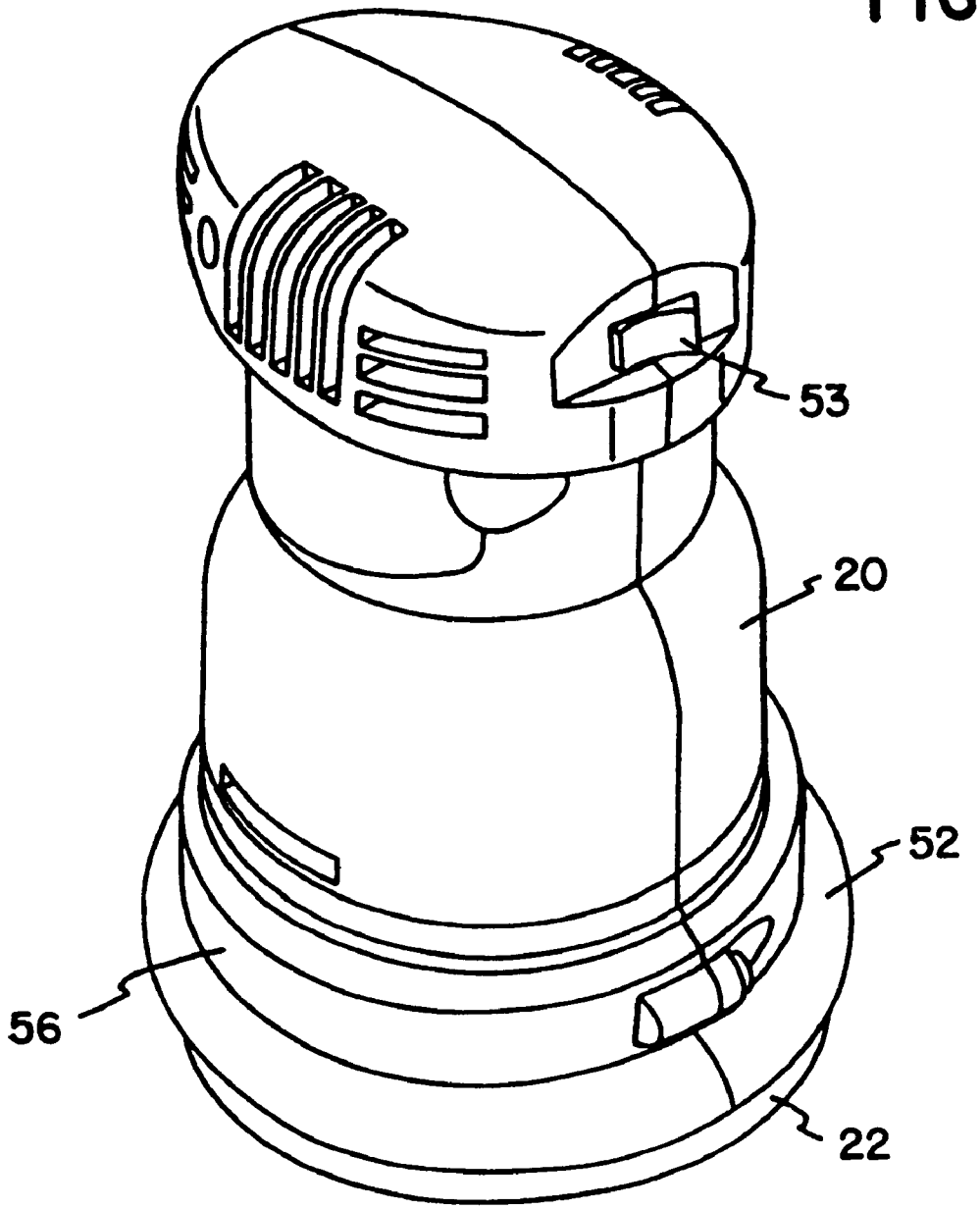
FIG. 1A illustrates a similar sander without a dust collection system.

FIG. 1 illustrates a sander having a body or housing 20 which is typically comprised of two halves secured together by conventional means and a pad 22 for holding sandpaper or other abrasives or materials (e.g., polishing pads) desired by the user. Such pads 22 can be configured in the pressure sensitive adhesive (PSA) variety as well as a hook and loop variety, each of which are familiar to those skilled in the art, and can be either with or without holes to incorporate either a sander with dust collection capability (for example, as shown in FIG. 1) or without such capability (for example, as shown in FIG. 1A). Pad 22 has an outer periphery substantially defining the size of sandpaper or other material supported by the pad.

The sander shown in FIGS. 1 and 1A have a body or housing 20 sized for a palm grip at the top of the housing and for a single-handed grip around the body. A motor housed by body 20 typically comprises an armature 24, a field 26, and brush and spring assemblies 28. Upper and lower ball bearings 30 and 32 are supported by the housing and provide stability and smooth operation for motor shaft 34. For a random orbit sander of the type shown, motor shaft 34 is typically directly coupled to a counterweight 36, which may incorporate integral fan blades 37 used for dust collection.

In the embodiment shown, pad support 38 is coupled to counterweight 36 by a ball bearing 40 having its outer race diameter press fit into a cylindrical cavity 42 defined by pad support 38 and the inner diameter of its race slip fit onto an eccentrically-located cylindrical protrusion 44 of counterweight 36. The connection between counter-weight 36 and pad support 38 imparts an orbital motion to the pad support 38. Pad support 38 is shown further secured to armature shaft 34 by a machine screw 46, which ensures a secure assembly of the counterweight 36, bearing 40 and pad support 38. Pad 22 is typically secured to pad support 38 by threaded machine screws 48.

Figure 3:
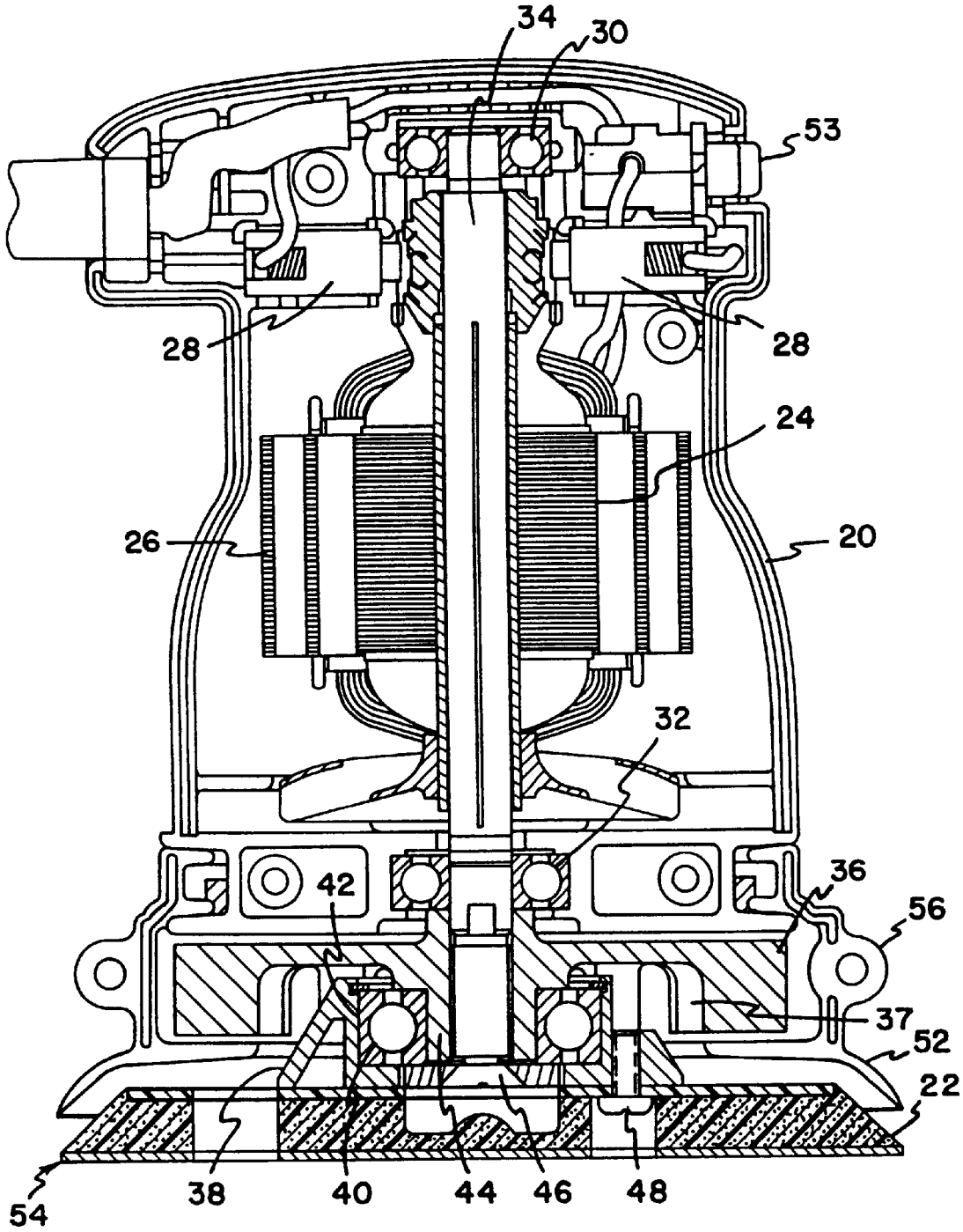
FIG. 3 shows a cross-sectional view of a sander.

As has previously been indicated, the sander motor in the embodiment shown is powered electrically and for this purpose includes a power cord 50 with power being controlled by an on/off switch 53. Those skilled in the art will recognize many other components illustrated in the cross-section of FIG. 3 as being typical to the assembly of an electrically driven sander of a random orbit nature. Those skilled in the art will also recognize that suitable components of the sander shown could be replaced with well-know components if a sander of the orbital or dual-action variety is desired. Furthermore, in embodiments driven by an air motor, power cord 50 would be replaced by an air hose, and the components previously described which relate an electric motor would be replaced with suitable air motor components. Motors used in the preferred embodiments have a typical no-load speed of 12,000 RPM.

For the preferred random orbit sanders shown in the present application, when a sander is not in contact with the work, the rotational restraint established between the inner race, balls, seals, grease, and the outer race of the bering 40 causes the pad assembly to spin at the same speed as the motors haft. When the abrasive or other material mounted to pad 22 contacts the work, another rotational restraint is created which opposes the bearing restraint. This additional restraint varies with pressure, abrasive grade, etc. Through this process, the rotational speed of pad 22 (ie., of the outer race of bearing 40) is reduced to approximately 300 RPM, while the orbital motion (inner race of bearing 40) continues at a higher speed (12,000 OPM). In this manner, since the rotational speed of the pad is not synchronized with the orbital motion of the pad, the abrasive particles are made to travel in a "random orbital motion."

The sanders shown in the present application comprise a skirt 52 which flares out over the periphery 54 of pad 22. As with housing 20, skirt 52 is preferably formed of a rigid material (for example, polyamide) and is spaced slightly upward from pad 22, giving pad 22 sufficient clearance from skirt 52 so that the sander can operate properly and so that dust can be pulled up between the periphery of pad 22 and skirt 52 by fan blades 37. As previously indicated, fan blades 37 may be integrally formed in a central open region interior to counterweight 36.

In the preferred embodiment, skirt 52 is formed integrally with a lower housing 56, which is configured so that it can be selectively rotated about sander body 20 for enabling the lower housing to be oriented in a position desired by the user. The position selected by the user is typically maintained by friction between the exterior lower portion of the sander body 20 and the interior portion of lower housing 56, each of which have complementary shapes to ensure retention of the lower housing on the sander body while enabling rotational adjustment. The ability to adjustably position lower housing 56 is particularly advantageous when lower housing 56 comprises a dust collection system defining a dust exhaust channel such as 58. Such a dust exhaust channel may be coupled either to a passive dust collector such as a bag or filter housing 60 or by a hose to an active system such as a vacuum cleaner. In these scenarios, users may wish to adjust the position of the collection system with respect to sander or workpiece features.

Figure 2:
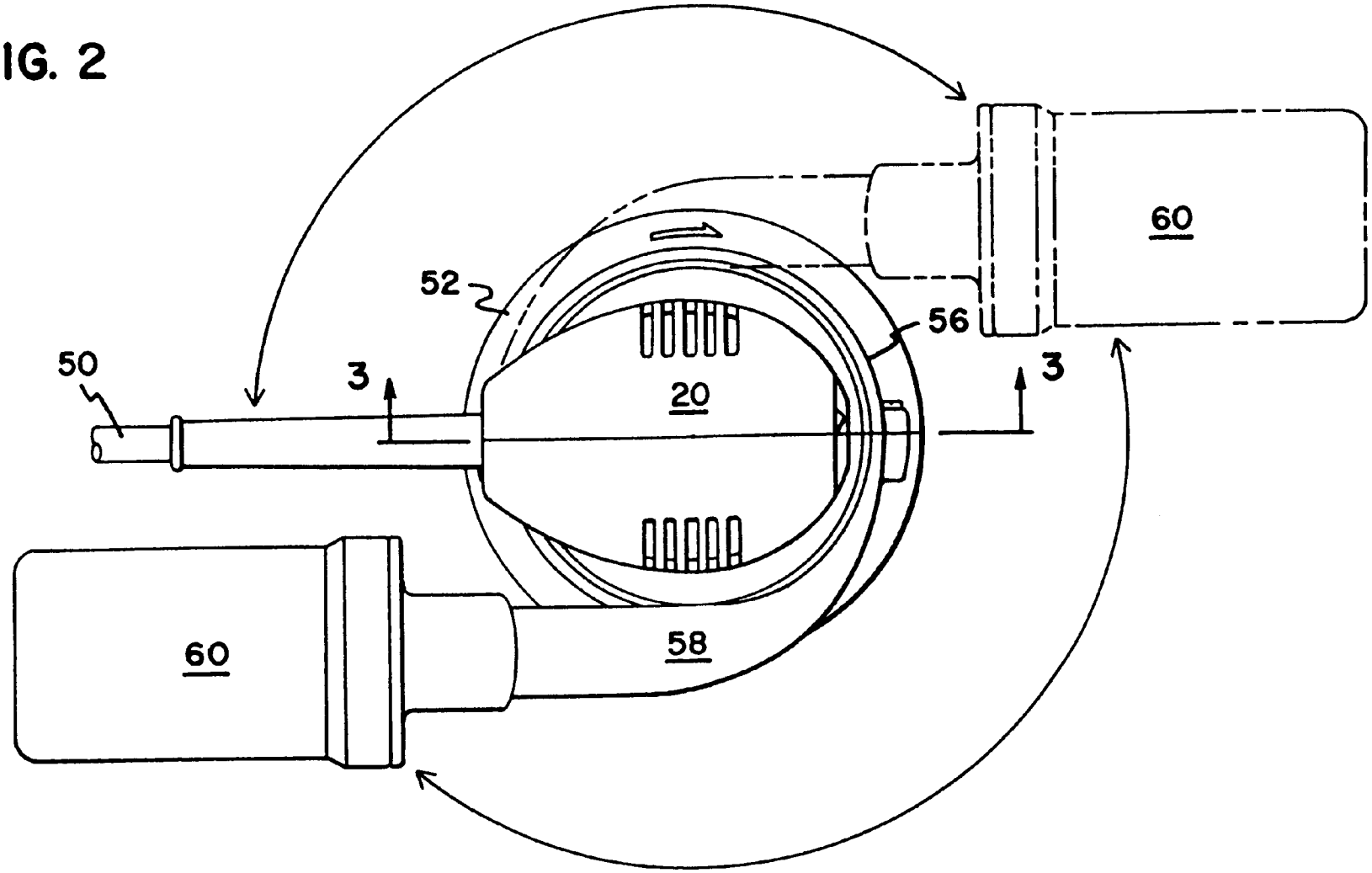
FIG. 2 is a top view of a sander showing a dust collection system which can be rotationally oriented in a direction selected by the user.

As with body 20, lower housing 56 may comprise two halves secured together by conventional means. For the version of the sander disclosed which incorporates dust collection, dust collection channel 58 is defined in part by a portion of lower housing 56. FIG. 2, which is a top plan view of the preferred sander embodiment comprising a passive dust collection system, illustrates how lower housing 56 may be selectively swivelled in a rotational manner to a position desired by the user. As can be seen, such positioning will enable the user to orient the direction of exhaust port 58 in a preferred direction relative to, for example, power cord 50.

Figure 4:
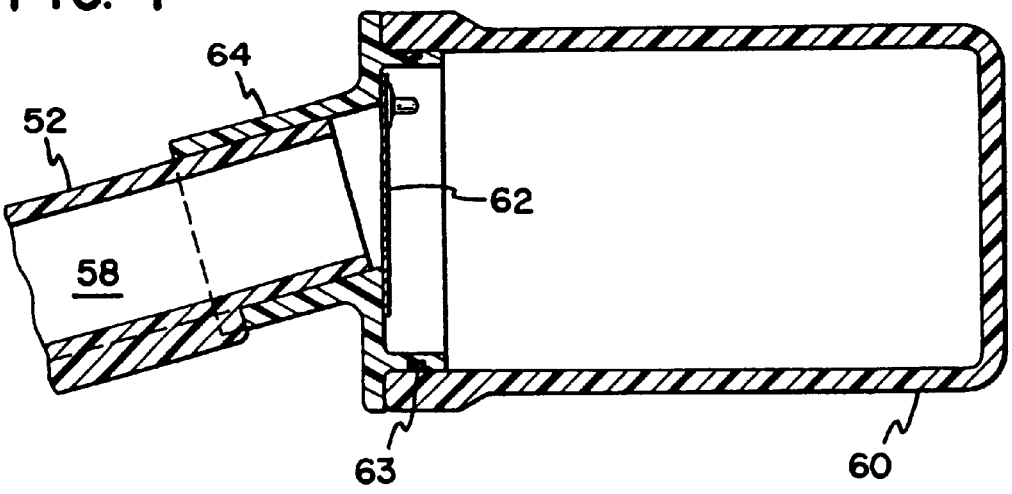
FIG. 4 illustrates a dust collection housing.
Figure 5:
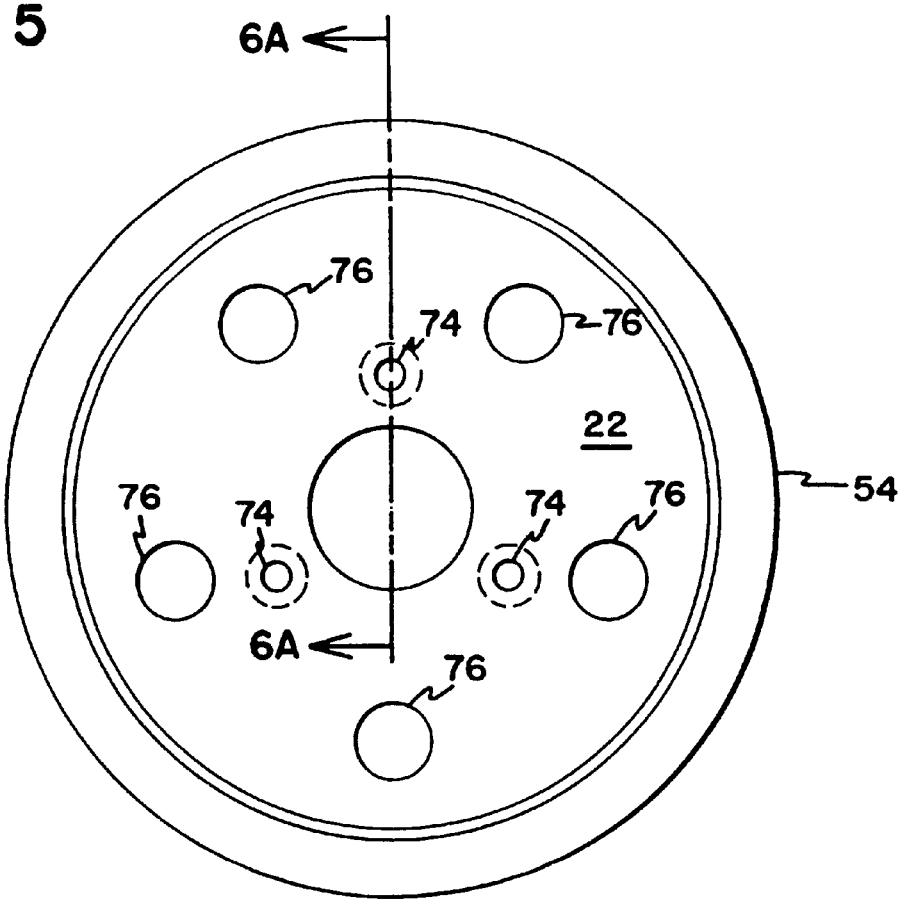
FIG. 5 illustrates a top plan view of a sanding pad which incorporates dust collection holes.
Figure 6A:
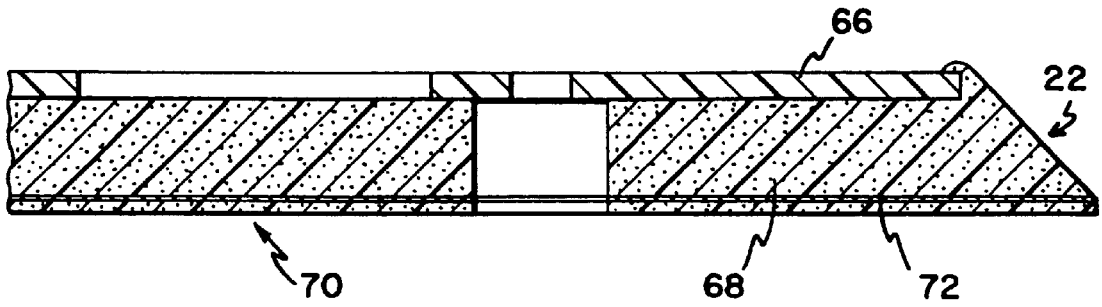
FIG. 6A and 6B illustrate alternative embodiments of a sander back-up pad.
Figure 6B:
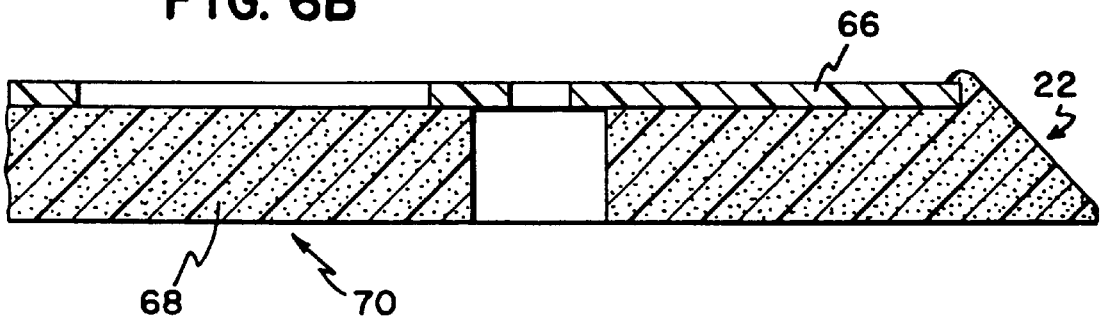

The preferred dust collection system is shown cross-sectionally in FIG. 4. Note that the preferred system incorporates a membrane 62 which maintains a normally closed position in order to prevent the back flow of dust collected within filter 60 while enabling dust to enter the filter. Membrane 62 may be formed of polyester film having a nominal thickness of 0.007 inch. Filter housing 60 is typically coupled via friction fit to an adapter 64, which in turn fits fictionally over dust exhaust channel 58 of housing 52 in order to removably interconnect the filter and adapter assembly with the sander exhaust port. O-ring 63 retained in place by a detent in adapter 64 helps maintain a good friction fit and seal for enabling long-life and easy removal of housing 60 from adapter 64. When filter housing 60 is full of dust, it can be removed from adapter 64 and emptied by simply twisting housing 60 off of adapter 64 and tapping the filter housing briefly in order to empty it of dust. Note that, during this emptying procedure, membrane 62 preferably remains with adapter 64 and does not interface with emptying filter housing 60.

In the preferred embodiment, filter housing 60 is formed by molding, sinterring or by other means a rigid, porous, plastic material, preferably porous polyethylene, polypropylene, polystyrene, or other polyolefins having a pore size effective to retain sanding dust; it has been found that a pore size of 120–140 microns is satisfactory. In the embodiment shown, filter housing 60 is substantially cylindrical and has an internal diameter of approximately two inches, a length of approximately four inches, and a typical wall thickness of 0.15 inch. Those skilled in the art will recognize that other sizes and shapes of sander filters consistent with the present filter invention may also be useful.

In the sander embodiments shown, pads 22 are typically five inches in diameter and comprise an upper member 66 of fiberglass-reinforced epoxy molded into a lower member 68, which may be formed of integral skin-cast polyurethane. As is familiar to those skilled in the art, for pads used with PSA, a vinyl sheet is typically applied to the lower surface 70 of lower pad member 68. This vinyl material is normally coated such that PSA sandpaper or the like will stick to the surface and yet, when the paper is removed, little or not abrasive will be present on the vinyl sheet. Pads 22 are typically rated for 13,000 RPM. PSA pads with lower surface 70 formed of vinyl or similar material may include an embossed grain applied in a mold (a surface familiar to those skilled in the art used with pressure-sensitive adhesive for adhering materials such as abrasive sheets to the pad). Alternatively, lower surface 70 may be formed of short-stemmed hook and loop material applied in the mold (a surface likewise familiar to those skilled in the art for use in connection with abrasive sheets or the like backed with hook and loop material).

In prior-art sander configurations operating in the random orbit mode, pad 22 is typically free of rotational restraint such that pad 22 may achieve a very high RPM when the motor is running and the sander is lifted off of the work. In such situations, if lower member 68 of pad 22 is formed of typical prior-art materials such as cast polyurethane foam, the pad may expand radially outward. Radial pad expansion in this manner can cause a sanding sheet adhered to the bottom face 70 of the pad to be released when PSA is used to bond the abrasive sheet to the pad. This release of the adhesive sheet has been found to be caused by the differential movement in the interface between bottom surface 70 of the pad and the adjoining layer of the adhesive sheet, resulting in release by the PSA of the sanding, sheet. Such released abrasive sheets can be inconvenient to the user.

Accordingly, it has been found that use of an anti-radial-expansion mechanism coupled proximate the lower surface 70 of sanding pad member 68 can substantially prevent radial expansion of the pad and substantially eliminate the problem of PSA bonding failures between the pad and the adhesive sheet. In one preferred embodiment, the anti-radial-expansion system is achieved by molding a layer 72 of vinyl-coated fiberglass insect screening into the lower portion of pad member 68. Such insect screening may have a mesh of 18 by 16 strands per inch with a strand diameter of 0.011 inch. Other similar fiberglass screening or materials may also be used in order to prevent the previously described radial expansion problem. An alternative is use of a square-weaved cloth backing molded into the vinyl coating at the bottom of the pad.

Pads 22 are typically secured to pad support 38 by machine screws 48 passed through mounting holes 74 formed in upper fiberglass member 66. In sanding pads which comprise vacuum holes 76, the vacuum holes are preferably molded in and not machined.

At the time of filing the present application, preferred embodiments of the sanders disclosed can be obtained from Porter-Cable Corporation, the assignee of the present application, in three models. A model 332 does not incorporate dust collection and includes a PSA pad. A model 333 includes a dust collection system as well as a hook and loop pad. A model 334 is similar to the model 333 except that it incorporates a PSA pad.

The present invention is to be limited only in accordance with the scope of the appended claims, since persons skilled in the art may devise other embodiments still within the limits of the claims.

What is claimed is:

1. A sander, comprising:

a. sanding means for providing a sanding function, the sanding means comprising a sander body, a pad for supporting sandpaper, the pad having an outer periphery,substantially defining the size of sandpaper supported by the pad, a motor housed by the sander body, and coupling means for coupling. the motor to the pad in order to impart a sanding motion to the pad; and b. a lower housing coupled to the sander body proximate the region of the pad, the lower housing comprising a skirt which flares out over the periphery of the pad, the lower housing comprising swivel means for enabling the lower housing to be selectively swiveled in a rotational manner to a position desired by the user.

2. A sander, comprising:

a. a sander body, a pad for supporting sandpaper, the pad having an outer periphery substantially defining the size of sandpaper supported by the pad, a motor housed by the sander body, and a coupler for coupling the motor to the pad in order to impart a sanding motion to the pad; and b. a lower housing coupled to the sander body proximate the region of the pad, the lower housing comprising a skirt which flares out over the periphery of the pad, the lower housing being coupled to the sander body such that the lower housing can be swiveled selectively in a rotational manner to positions desired by the user.

* * * * *